US005136557A

United States Patent [19]

Plawker et al.

[11] Patent Number: 5,136,557

[45] Date of Patent: Aug. 4, 1992

[54] MODULAR WATCH COLLAR

[75] Inventors: Ilan Plawker, Englewood Cliffs, N.J.; Howard Mendelowitz, Pomona, N.Y.

[73] Assignee: RPR Creative Marketing, Inc., Englewood Cliffs, N.J.

[21] Appl. No.: 647,069

[22] Filed: Jan. 29, 1991

[51] Int. Cl.[5] ..... G04R 37/00; A47F 7/00

[52] U.S. Cl. ..... 368/316; 248/116

[58] Field of Search ..... 368/10, 316-317, 368/327; 248/115-116

[56] References Cited

U.S. PATENT DOCUMENTS

| | | | |
|---|---|---|---|
| 3,312,435 | 4/1967 | Malone | 248/115 |
| 4,293,943 | 10/1981 | Avery et al. | 368/316 |
| 4,707,146 | 11/1987 | Wein | 368/316 |

*Primary Examiner*—Vit W. Miska

*Attorney, Agent, or Firm*—Henry R. Lerner

[57] ABSTRACT

A modular watch collar capable of multipositional use is disclosed herein. A detachable modular base plugs into a watchband holder in a variety of positions, and depending on the plug position, the modular base permits the modular watch collar to be free-standing or to fit into a channel or groove located on a wall or display at any angle. A modular sign holder attachment plugs into the modular watch collar and is positionable at a variety of locations thereon.

14 Claims, 6 Drawing Sheets

FIG. 6
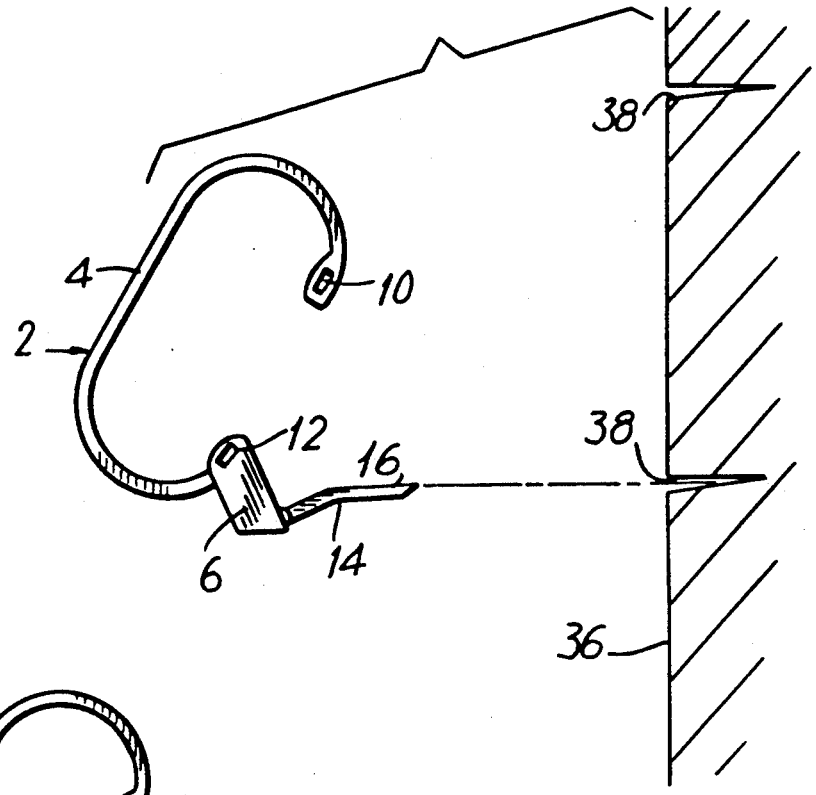
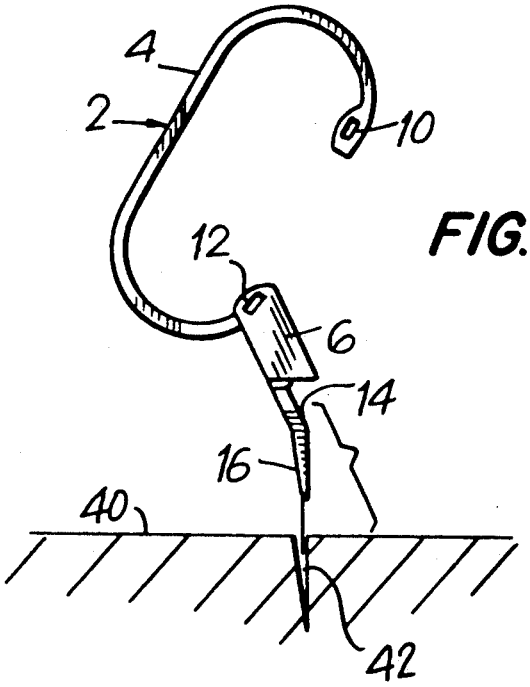
FIG. 7
FIG. 8
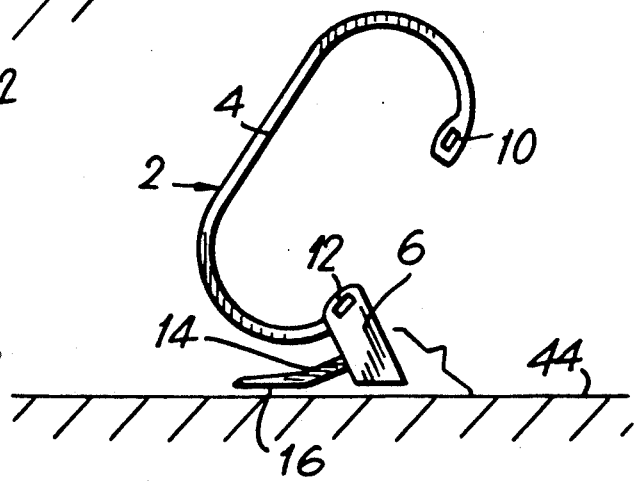

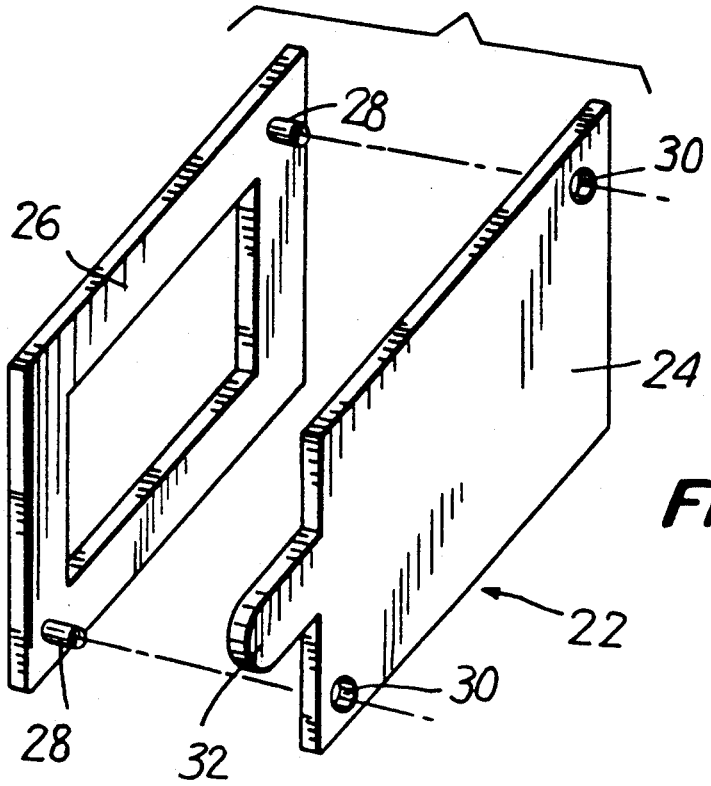
FIG. 9
FIG. 12
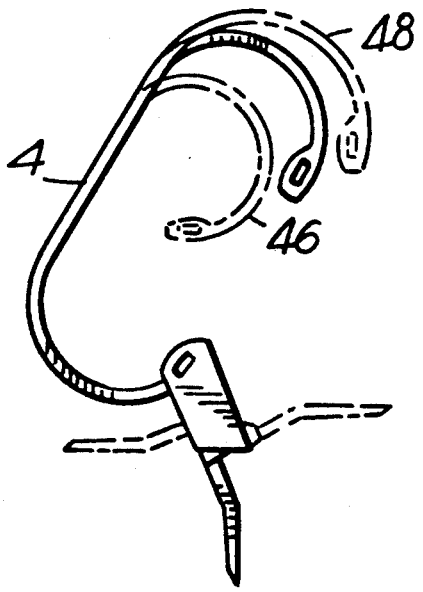

MODULAR WATCH COLLAR

BACKGROUND OF THE INVENTION

The present invention relates to display devices for presenting time-keeping wrist watches. The instant device allows a watch to be displayed securely in a variety of positions, angles and locations without requiring separate display devices to suit each position, angle or location. More specifically, the instant invention provides a modular means for adjusting the way in which a watchband collar can be set into various display modes and further provides a modular sign holder system which is adjustable to various positions of display.

Typical wrist watch display collars are rigid, one-piece units. Such watch displays usually have a C-shaped or oval member for supporting a watchband in a fixed position whose inclination is determined by a fixed base. The rigid nature of the prior art watch display collar permits the watch to be displayed at a single vantage point or angle from a display case or countertop. The fixed base allows the watch display collar to be free-standing, i.e., the base has sufficient surface area on which it can adequately support the watch display collar in conjunction with the watch itself.

Other typical watch displays may be positioned by inserting an integral projecting pin into a receptacle mounted on a wall or display case. The integral projecting pin is permanently attached at a fixed position on the watch display. These watch displays may be mounted wherever there is a receptacle, e.g., mounted vertically against a wall or in a display case. The receptacles for the projecting pins are usually spaced at fixed intervals which consequently determines the maximum number of watches in a display. A vertical arrangement of watch displays is a convenient space-saver in a crowded store. Thus, many watches can be displayed on an entire wall.

Unfortunately, typical watch display collars containing a permanently fixed integral pin are not adaptable to function as a stand-alone watch display collar without the presence of a separate foot base to support the match display collar and watch. Likewise, a stand alone watch display collar is not adaptable for placement in a vertical wall display without the presence of a pin or other attaching means. The combination of both the attaching means and footbase at separate locations on a single watch display is undesirable because of the added expense involved in providing extra materials used in manufacturing such a watch display. Moreover, the presence of needless (depending on the position) functional appendages creates a clumsy and unsightly display package.

There thus exists a need for a watch display collar capable of supporting a watch in free-standing manner as well as on a vertical display without incorporating excess manufacturing material and needless unsightly appendages. A universal watch display would eliminate multiple dies in the manufacture of watch displays and permit adaptation to a number of different positional displays. The instant invention provides a solution to these problems, among others.

SUMMARY OF THE INVENTION

The present invention relates to a modular watch display collar which is stable and positionable at a number of angles and is either self-standing or otherwise positionable through modular integral support means. This is accomplished via a detachable modular support base which attaches to a watchband holder. The modular support base is adapted to be inserted into a groove or channel located in a wall, countertop, or any other display means which can be positioned at any angle relative to the ground. The modular base may be rotated around a fixed axis on the display collar. In a preferred embodiment, the combination of the detachable modular base and the display collar provide three possible positions, i.e., 1) self-standing, 2) wall, and 3) channel wherein the detachable modular base extends, respectively, forwardly, rearwardly, and/or downwardly under the display collar.

The instant invention also encompasses a modular sign holder which is adapted to releasably attach to the display collar at various points. In a preferred embodiment, the detachable sign holder is made of two separate pieces: one framing a sign, and the other providing a base for the sign.

The instant invention thus provides a convenient, simple solution to problems created by the necessity of using a plurality of different watch display collars suitable for differing locations. A universal watch display collar is provided herein which saves materials, space, and is capable of performing several functions heretofore requiring a plurality of watch display collars.

BRIEF DESCRIPTION OF THE DRAWINGS

FIG. 6 is a side view of the instant invention wherein a detachable modular base is attached and positioned for insertion into a channel or groove in a wall.

FIG. 7 is a side view of the instant invention wherein a detachable modular base is attached and positioned for downward projection into a channel or groove.

FIG. 8 is a side view of the instant invention wherein a detachable modular base is attached and positioned for a self-standing modular watch collar.

FIG. 9 is an exploded perspective view of a sign holder.

FIG. 12 is a side view of the collar illustrating its ability to be deformed when made of Hi Impact ABS.

DETAILED DESCRIPTION OF THE DRAWINGS AND THE INVENTION

Figure 1:
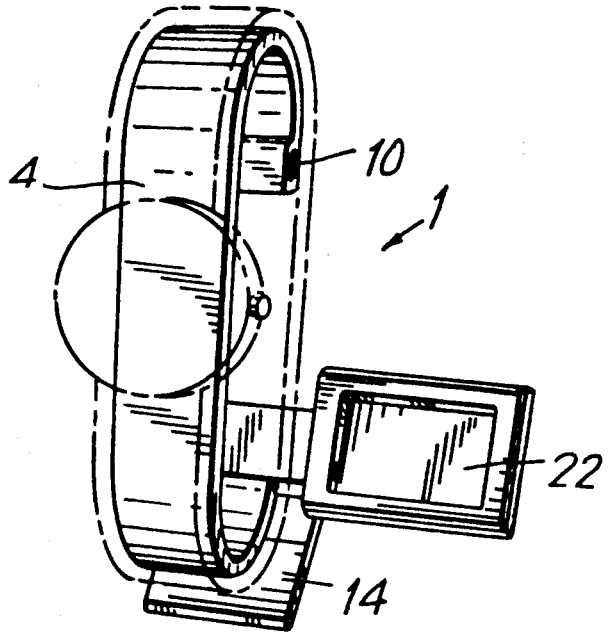
FIG. 1 is a perspective view of a modular collar in a self-standing mode wherein a sign holder is attached to the lower right hand side of the modular watch collar.

FIG. 1 illustrates a modular watch collar 1 in a self-standing mode. A modular detachable base member 14 extends in a frontward direction relative to its position under a C-shaped watchband holder 4. A sign holder 22 is attached to the C-shaped watchband holder 4 at the lower righthand side thereof. In this position, the modular watch collar 1 can be placed securely in or on top of a display case or countertop for viewing purposes. The details of construction of holder 4, base member 14, sign holder 21 and the manner of assembling the components to define the modular watch collar 1 will be more fully discussed hereafter.

The self-standing modular watch collar 1 provides a stable configuration to support a wrist watch and a prospective purchaser of the watch can easily pick up the entire assembly and put it back down to observe the merchandise at a distance.

Figure 2:
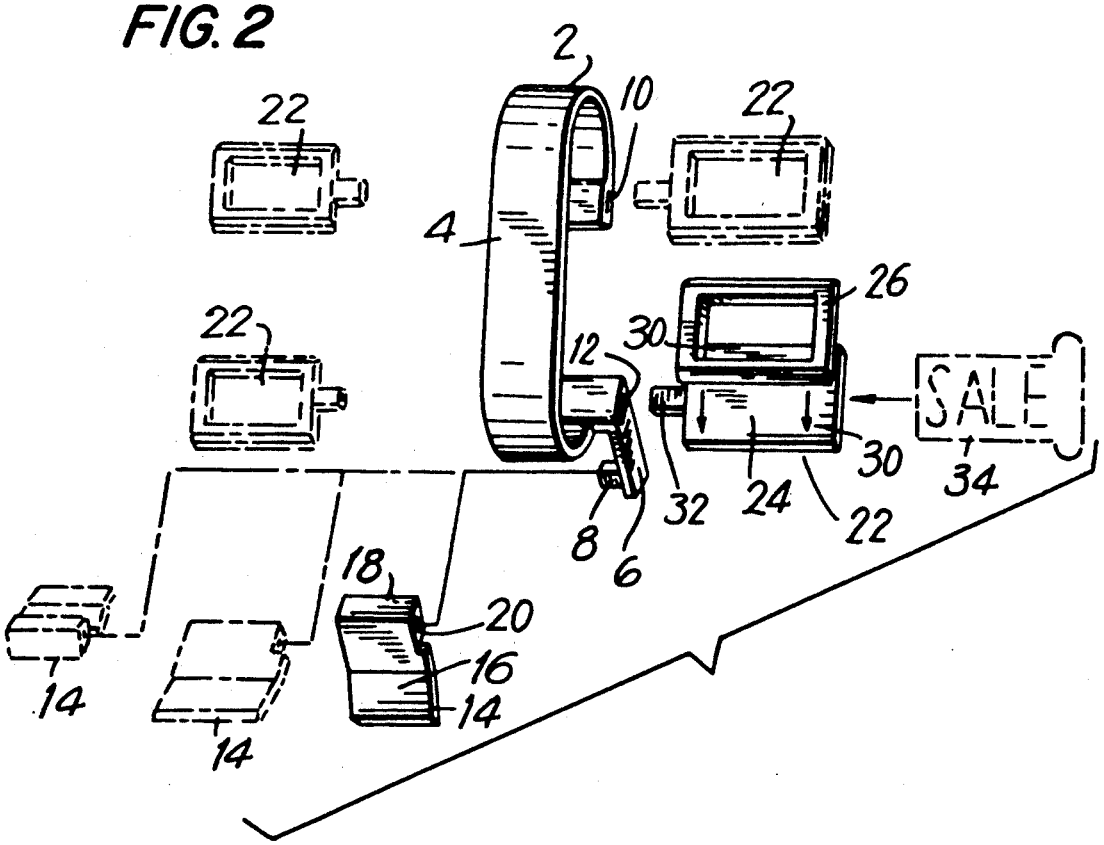
FIG. 2 is an exploded perspective multi-informational illustration of the instant invention.

FIG. 2 illustrates a preferred embodiment of the instant invention in disassembled multi-combinational form. FIG. 2 also serves to illustrate generally the versatility of the instant invention.

The C-shaped watchband holder 4 is seen to be central to the various embodiments. A sign holder 22 can be attached in four locations, i.e., upper left, upper right, lower right, and lower left. The detachable modular base 14 is shown in three possible preferred positions as each would attach to the C-shaped watchband holder 4 by means of a footpin 8 which is insertable in footpin receiving aperture 20 in the modular base 14. In accordance with the invention, one or more sign holders 22 may be attached at various locations on the collar 2 by insertion of sign holder tongue 32 in one of four complementary apertures disposed in the collar 2. The sign holder may contain signs depicting information that a merchant would like to associate with the goods he or she is selling, i.e., model number, price, SALE!, etc.

Figure 3:
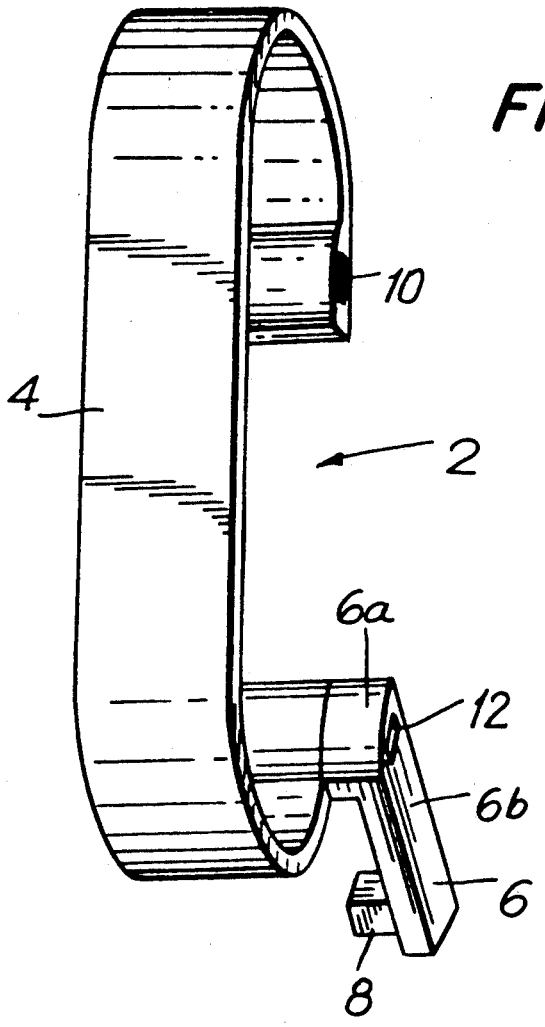
FIG. 3 is a perspective view of a modular collar according to the instant invention.

FIG. 3 illustrates an isolated view of a collar 2. The collar 2 is comprised of a C-shaped watchband holder 4, a collar leg 6 to facilitate attachment of the collar 2 to the detachable modular base member 14, a foot pin member 8 to couple with the detachable modular base member 14, and upper and lower sign holder member receiving slots 10 and 12, respectively. The C-shaped watchband holder 4 is adapted so that a watchband can fit snugly around it and remain stable. A slightly elongated center portion along the C-shape presents a level surface to support the back of the time-piece itself. The upper slot receptacle 10 adjacent to the upper end of the holder 4 is adapted to receive a sign holder tongue 32 such that the sign holder 22 is mounted securely thereto. The upper slot receptacle 10 may have a rectangular cross section and extends through the entire width of the C-shaped watchband holder 4, thus forming a continuous tunnel which defines openings on either side of the watchband holder 4 which allows the sign holder tongue 32 of the sign holder 22 to be received on either the upper left or right sides of the collar 2. Likewise, a lower slot receptacle 12 extends adjacent the lower end of holder 4 through the entire width of the C-shaped watchband holder 4 and is thus capable of supportingly engaging the sign holder 22 on either the lower left or right sides of the collar 2. It is therefore possible to position one or more sign holders 22 in each, any, or all of the positions which are provided.

It will be noted that providing slot receptacles 10 and 12 which extend through the entire width of holder 4 allows attachment to the collar of components having a part which passes through the entire slot and can then be pinched to secure the component in position on the holder. This allows watches with straps rather than bracelets to be held in place on the collar.

The collar leg 6 includes an upper portion 6a which is a lateral extension of lower end of the holder 4, a main leg portion 6b extending perpendicularly downwardly from upper portion 6a and a footpin 8 extending perpendicularly to the leg portion 6b and toward the holder 4. The collar leg 6 thus projects diagonally downward from the C-shaped watchband holder 4. The footpin 8 is adapted to mate with the detachable modular base 14. In a preferred embodiment, the footpin 8 has a rectangular cross section presenting four perpendicular planar surfaces to provide precise positioning when the detachable modular base 14 is engaged in the footpin receiving aperture 20. Although the footpin 8 is shown to have a substantially square cross section, other geometric shapes are within the scope of the instant invention. As will be discussed below, the geometry of the aperture 20 and footpin 8 control the functional positions of the various insertions.

Figure 4:
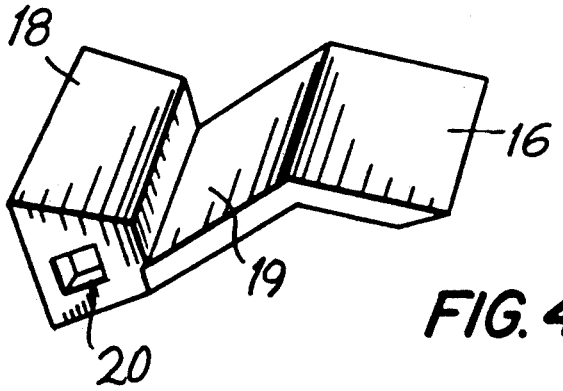
FIG. 4 is a perspective view of a detachable modular base according to the instant invention.

FIG. 4 illustrates a detachable modular base 14. The modular base 14 is adapted to engage the footpin 8 of the collar 2 in a variety of orientations to support the collar 2 in a variety of modes. The modular base 14 comprises a footbase member 16 at one end thereof, and, at the opposite end, collar leg mount 18 with a footpin receiving aperture 20 disposed therein, and an intermediate portion 19 whose bottom surface is angularly related to the bottom surface of the footbase 16. The outer edge of the footbase 16 is beveled to define a knife edge for reasons to be more fully described hereafter.

The footpin receiving aperture 20 is adapted to tightly receive the footpin 8 which slides into, and is securely held by friction in the footpin receiving aperture 20. When the footpin 8 is inserted into the footpin receiving aperture 20, the detachable modular base member 14 becomes integrally attached to the collar leg mount 18 forming a stable base which supports the modular watch collar 1.

The footbase member 16 is adapted to provide an even distribution of the weight of the modular watch collar 1 onto any surface it rests upon. In a preferred embodiment, the collar leg mount 18 provides a surface which is coplanar with the footbase member 16, so as to create a combined surface which maximizes surface area contact of the detachable modular base 14 when the modular watch collar 1 is in the free-standing mode.

Figure 5:
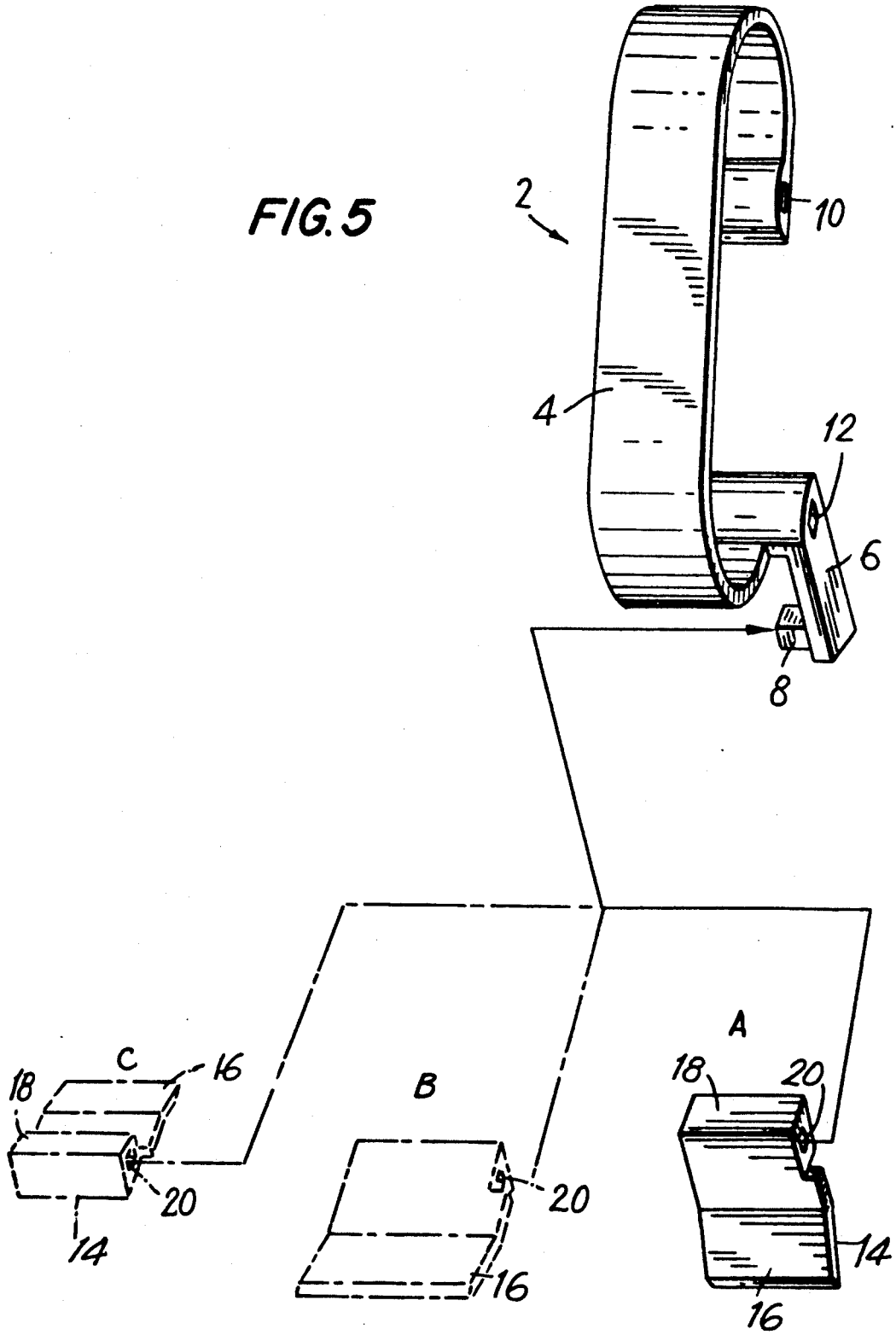
FIG. 5 is a depiction of various positional combinations possible between a modular collar and detachable modular base.

FIG. 5 illustrates the various orientations relative to the collar 2 that the detachable modular base 14 may be placed in. In a preferred embodiment, the detachable modular base 14 may assume three positions in relation to the collar 2. Each position is determined by the interconnection between the footpin receiving aperture 20 and the footpin 8 of the collar 2. The square cross sectioned footpin 8 presents four planar surfaces to the complementary cross sectioned footpin receiving aperture 20. The result is a complementary "lock and key" fit capable of 90° rotations. The three assumable positions are (1) the footbase 16 pointing downwardly in relation to the collar 2 and as illustrated in 5A, (2) forwardly as is illustrated in 5B, and (3) backwardly as is illustrated in 5C. Each orientation is adaptable to different display means as needed and is further elaborated on below.

FIG. 6, is a side view of an embodiment of the invention in which the footbase 16 is shown to point backwardly in relation to the collar 2 and the modular watch collar 1 is thus capable of being positioned in a channel or groove in a wall display. In this embodiment, the attachable modular base 14 engages the footpin 8 as is illustrated in FIG. 5C, i.e., the footbase number 16 faces back and away underneath the collar 2. As FIG. 5C further illustrates, the footpin receiving aperture 20 is adapted to couple with the footpin 8 like a lock and key to provide a stable link between the detachable modular base 14 and the collar 2. As is seen from FIG. 6, the modular watch collar 1 is now in position for a wall channel or groove setting mode. The backwardly pointing footbase member 16 can be inserted into a wall display 36 within a channel or groove 38. The detachable modular base 14 is adapted to slide in or out of the groove or channel 38 so that the modular watch collar and watch are safely and securely held in the display 36. The beveled edge of footbase member 16 facilitates insertion into and removal from the channel or groove. Thus, in accordance with the invention, a series of horizontal channels or grooves may be placed into or against a wall to provide the means by which a display is accomplished.

In order to achieve a second position, i.e., to position the modular base 14 downwardly, the detachable modular base 14 is rotated 90° in relation to the backward or wall position shown in FIG. 6 and then attached to the collar 2. As can be seen from FIG. 5A, the footbase member 16 is positioned downwardly below and perpendicular to the collar 2 and the footpin receiving aperture 20 couples with the footpin 8, such that a stable interlock is formed. FIG. 7 illustrates this mode as a side view of the modular watch collar 1 wherein the detachable modular base member 14, and consequently, the footbase member 16 project downwardly to be received by a channel or groove 42 on a horizontal surface. The downward position of the detachable modular base member 14 determines the angle of the modular watch collar 1 which in turn determines the view of the watch held by the collar 2.

To achieve a third position, the detachable modular base 14 may be rotated 90° in relation to the downward position described above (or 180° in relation to the backward wall channel position also described above) such that the footbase member 16 extends forwardly underneath the collar 2. As can be seen in FIG. 5B the footpin receiving aperture 20 is capable of receiving the footpin 8 like a lock and key, thus forming a stable self-standing base assembly to support a watch. FIG. 8 illustrates this mode as a side view of the modular watch collar 1 wherein the detachable modular base 14 is positioned to allow the modular watch collar 1 to be free-standing. The detachable modular base 14, and consequently, the foot base 16 project forward beneath the collar at a centralized point such that the center of gravity is evenly distributed over the detachable modular base 14. The free-standing watch collar 1 can thus be placed on a surface 44 for display.

In the self-standing mode, the weight of the collar 2 and any watch positioned thereon is distributed evenly along the detachable modular base 14. A free-standing modular watch collar 1 is convenient for a free-standing display as well as during the actual sales process. Watches held by the modular watch collar 1 can be taken from their display cases and positioned along a countertop for easy viewing and handling by a perspective customer. If the modular watch collar 1 has been held by either of the two channel display positions as described above, it may be removed, the detachable modular base 14 repositioned such that the modular watch collar 1 is now free-standing, and then placed upon a display counter for easy viewing and handling by a perspective customer.

According to the instant invention, the space between adjacent modular watch collars 1 is not fixed and regardless of which of the three modes the modular watch collar 1 is in, it may be moved laterally to achieve a fuller look when stocks are low by increasing the space between each modular watch collar 1. This is accomplished simply by sliding the footbase member 16 along the groove, channel or countertop. If there is an overabundance of stock, the space between each modular watch collar 1 can be reduced to accommodate the extra stock. As above, if a watch is the subject of an inquiry, the modular watch collar 1 supporting the watch may be removed from the channel or groove, the detachable modular base 14 repositioned so that the modular watch collar 1 is free-standing, and then placed down on a counter for display purposes. Keeping the watch on the modular watch collar 1 provides a psychologically attractive display means for the watch as opposed to simply laying the watch down on a countertop.

Figure 10:
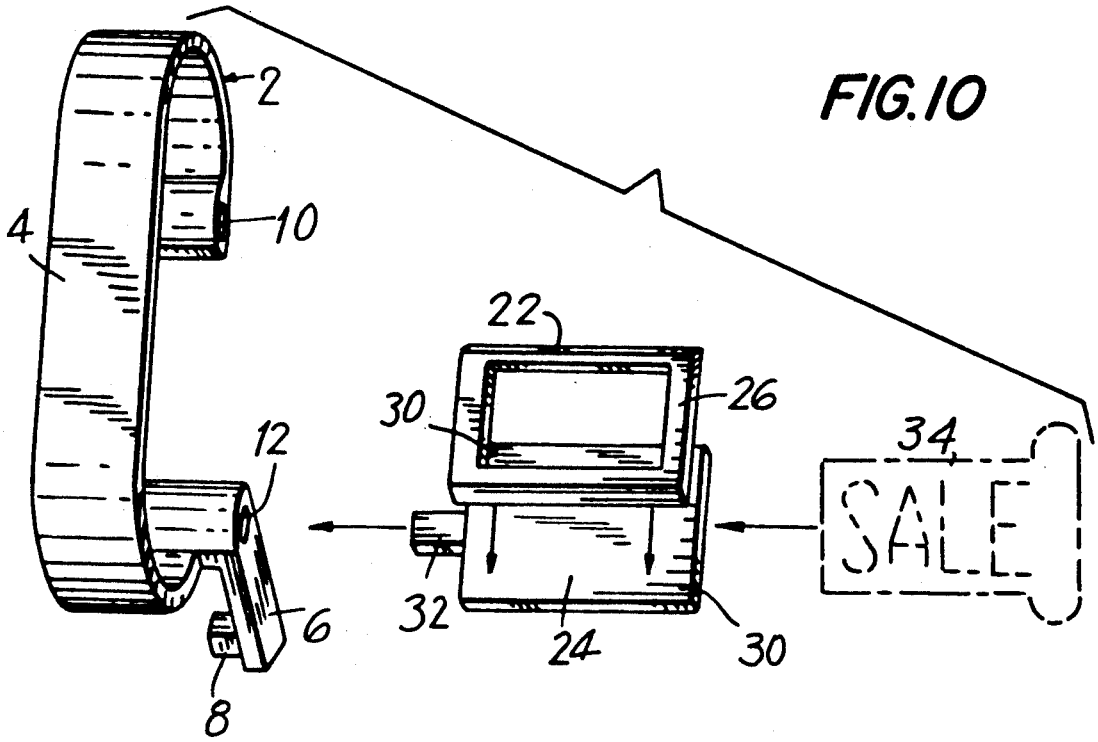
FIG. 10 is an exploded perspective view of a sign holder and its component parts as well as a depiction of relative placement of a sign insert, all of which is attachable to a modular watch collar.
Figure 11:
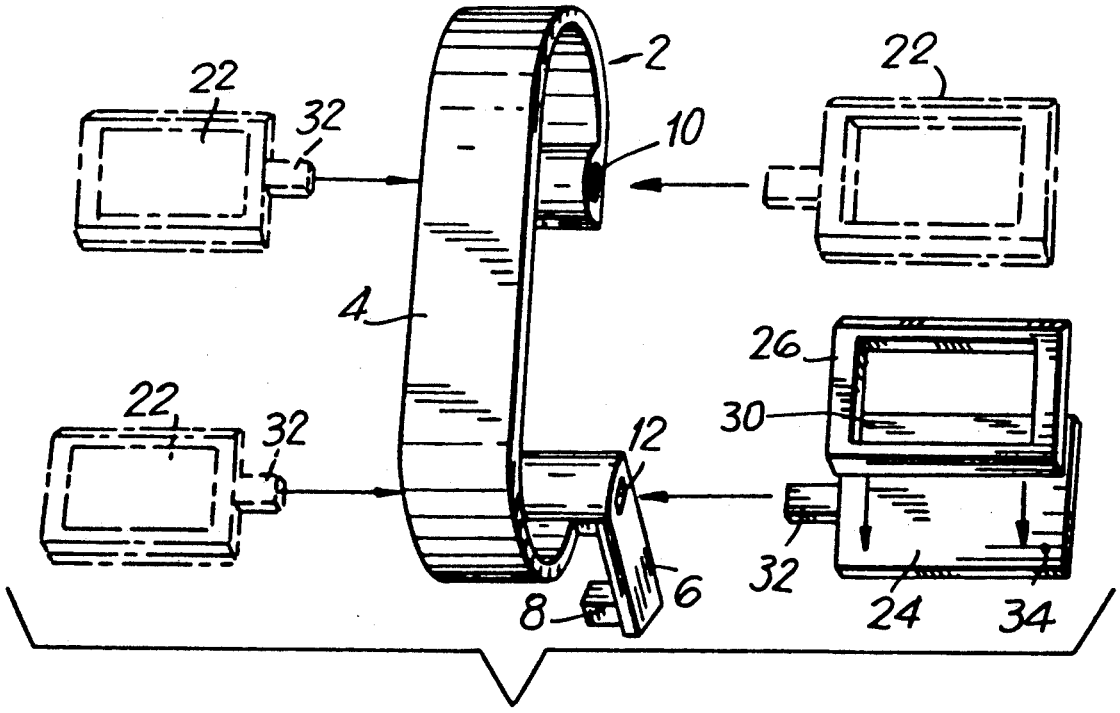
FIG. 11 is an exploded multi-informational view of the instant invention wherein various positions of a sign holder relative to a modular watch collar are illustrated.

FIGS. 9, 10 and 11 illustrate a modular sign holder 22 used in conjunction with the modular watch collar 1. FIG. 9 is an exploded view of the sign holder 22. A planar sign holder base member 24 couples to a detachable frame member 26 by means of frame pins 28 which are attached to the detachable frame member 26. The frame pins 28 couple with frame pin receptacles 30 on the sign holder base member 24. Alternatively, the frame pin 28 may be located on the sign holder base member 24 and the frame pin receptacle 30 may be disposed within the detachable frame member 26. In addition, one or more frame pins 28 and frame pin receptacles 30 may be positioned between the sign holder base member 24 and the detachable frame member 26. In a preferred embodiment, the sign holder base member 24 and the detachable frame member 26 are rectangular with two diagonally located distal frame pins 28 corresponding to two frame pin receptacles 30. The modular sign holder 22 is adapted to mate with the collar 2 by means of a sign holder tongue 32. Although the sign holder 22 is shown as substantially rectangular, it is contemplated that any suitable geometric shape is within the spirit and scope of the instant invention.

FIG. 10 is an exploded view of the assembly of the collar 2 to the modular sign holder 22 and a sign 34 that insertable into the holder 22. The holder 22 is separable into its component parts to facilitate insertion of a sign 34. When the sign 34 has been placed in the modular sign holder 22 and the component parts are put back together, the sign holder 22 can be inserted by means of tongue 32 into any of the slot receptacles 10 or 12 for the sign holder tongue 22.

FIG. 11 illustrates possible positioning of the modular sign holder 22 in relation to the collar 2. The upper slot receptacle for the sign holder tongue 10 permits placement of the modular sign holder 22 on either or both sides of the collar 2. Likewise, the modular sign holder 22 can be inserted on either side of the collar 2 at the lower slot receptacle for the sign holder tongue 12. Any number of sign holders can be used, the maximum number being limited only by the number of slot receptacles. Thus, in the embodiment illustrated in FIG. 11, four signs can be inserted on the collar 2. As previously noted, the through slot or tunnel can be used to secure to the collar components provided with a projection which extends through the entire slot and is thereafter pinched so as to be secured into position on the holder.

Watch collar 1 is preferably made of plastic which is molded into the requisite shape. In a preferred embodiment, the plastic used is Hi Impact ABS which allows holder 4 to be elongated or compressed so that it can be adapted to display a much wider range of bracelets. As shown in FIG. 12, the full lines illustrate the normal shape of holder 4 and phantom lines 46 and 48 illustrate holder 4 compressed and elongated, respectively, the deformation being achievable because of the use of Hi Impact ABS. ABS is the generic name for certain thermoplastic polymers which are fully described in MODERN PLASTICS ENCYCLOPEDIA 1985-1986 at pages 6 and 7.

While the invention has been described with collar leg 6 being fixedly secured to holder 4, it is within the scope of the invention to make such collar leg releasably engageable to holder 4 so that different collar legs 6, having different orientations can be attached to holder 4 and thereby obtain a different set of orientations for the base with respect to the holder, thereby permitting much greater versatility in mounting the display on whatever surface may be best available for display.

It will be appreciated that while the present invention has been described with reference to specific and preferred embodiments thereof, this is not done by way of limitation, and various modifications will suggest themselves to those of ordinary skill in the art which fall within the spirit and scope of the present invention as set forth in the appended claims. For example, the foot pin 8 and foot pin receiving aperture 20 have been described herein as having a substantially square cross section. However, numerous complementary geometric shapes can be incorporated. Thus, cylindrical foot pin 8 can mate snugly with a cylindrical foot pin receiving aperture 20. In this manner, the collar 2 would be rotatably positionable at any unencumbered angle relative to the detachable modular base member 14. Similarly, the foot pin 8 and foot pin receiving aperture 20 can be triangular, rectangular, or polygonal. The sign holder tongue 12 and complementary slot receptacles for the sign holder tongue can also be made rectangular, circular or polygonal as long as the shapes are complementary and still be within the spirit of the invention. The modular sign holder 22 has also been described as rectangular, but can be formed into other geometric shapes as well, such as circular or polygonal.

What is claimed is:

1. A device for displaying articles of the type adapted to be worn on a wrist by means of a wristband, comprising (a) a holder member adapted to support said wristband, (b) a modular base member, and (c) cooperating means on said holder and said base member for releasably securing said base member to said holder member in a plurality of relative orientations whereby said base member can be supported in a plurality of modes while maintaining the holder member in a wristband display position.

2. A device in accordance with claim 1, wherein said cooperating means comprise a pin on said holder member and a complementary aperture in said base member.

3. A device in accordance with claim 1, wherein said pin and said aperture have substantially the same square cross section, whereby said pin is insertable in said aperture in at least three different orientations in order to provide, in turn, at least three different supporting modes for the device.

4. A device in accordance with claim 2, wherein said holder member is C shaped and has a leg at its lower end comprising an offset upper portion extending diagonally downwardly and carrying said pin which is directed back toward the holder member.

5. A device in accordance with claim 3, wherein said modular base member comprising an elongate member having an enlarged portion at one end and a tongue at the opposite end, the bottom surface of said tongue being co-planar with the bottom surface of said enlarged portion, said aperture being located in said enlarged portion.

6. A device in accordance with claim 5, wherein said pin is receivable in said aperture in a first orientation wherein said modular base member extends rearwardly below the holder member to enable the device to be free standing with said co-planar surfaces of said base member in resting engagement on a horizontal display surface.

7. A device in accordance with claim 6, wherein said pin is receivable in said aperture in a second orientation which is 90 degrees from said first orientation in which said tongue extends downwardly so as to be insertable in a horizontally extending groove and the device assumes its normal display mode.

8. A device in accordance with claim 7, wherein said pin is insertable in said aperture in a third position 180 degrees from said first orientation in which said tongue extends rearwardly and is adapted to be inserted in a vertically extending groove and the device assumes its normal display mode.

9. A device in accordance with claim 4, wherein there is provided at least one sign holder which is releasably secured to the holder member.

10. A device in accordance with claim 9, wherein said releasable securing means comprise at least one slot on the holder and a complementary projection on said sign holder.

11. A device in accordance with claim 8, wherein there is provided at least one sign holder which is releasably secured to the holder member.

12. A device in accordance with claim 11, wherein said releasably securing means comprise at least one slot on the holder and a complementary projection on said sign holder.

13. A device in accordance with claim 1 wherein said holder member is made of high impact ABS whereby said collar is compressible and elongatable in order to permit deformation of said collar to accommodate a wide range of wrist bands.

14. A device in accordance with claim 4 wherein said leg is releasably engageable with said holder whereby a plurality of different legs are engageable with the holder whereby to provide a plurality of different orientations for the base member.

* * * * *